United States Patent [19]

Pierret

[11] Patent Number: 4,546,753

[45] Date of Patent: Oct. 15, 1985

[54] IGNITION COIL FOR INTERNAL COMBUSTION ENGINES

[75] Inventor: Jean M. Pierret, Paris, France

[73] Assignee: Ducellier & Cie, Creteil, France

[21] Appl. No.: 600,638

[22] PCT Filed: Jul. 1, 1983

[86] PCT No.: PCT/FR83/00131

§ 371 Date: Apr. 5, 1984

§ 102(e) Date: Apr. 5, 1984

[87] PCT Pub. No.: WO84/00843

PCT Pub. Date: Mar. 1, 1984

[30] Foreign Application Priority Data

Aug. 11, 1982 [FR] France ..... 82 13965

[51] Int. Cl.[4] ..... F02P 3/02; H01F 27/30

[52] U.S. Cl. ..... 123/634; 336/110; 336/234

[58] Field of Search ..... 123/634, 635; 336/110, 336/182, 212, 234

[56] References Cited

U.S. PATENT DOCUMENTS 1,545,429 7/1925 Hunt ..... 336/178 X
1,623,426 4/1927 Mallory .
1,953,174 4/1935 Hartzell ..... 123/634 X
4,099,510 7/1978 Perrier et al. ..... 123/634

FOREIGN PATENT DOCUMENTS 1048081 12/1953 France .
2269786 11/1975 France .
2476218 8/1981 France .
2486160 1/1982 France .
677051 8/1952 United Kingdom ..... 336/178

*Primary Examiner*—Tony M. Argenbright
*Attorney, Agent, or Firm*—Holman & Stern

[57] ABSTRACT

A coil including a closed magnetic circuit (1), constituted by metal sheets which are stamped and stacked, so as to form a first part (12) which is U-shaped, of which one of the portions (12*a*) is stamped with a chamfered edge (12*b*), a second part (13), which is L-shaped, has a portion (13*a*) stamped with a chamfered edge (13*b*) such that after an insulating housing (6) containing the primary (4) and secondary (5) windings has been located on the arm (8) and a permanent magnet (2) has been inserted between the chamfers (12*b* and 13*b*) the first and second parts (12 and 13) are made rigid, by means of rivets (14, 15) and extensions (9*b*) of the metal plates (9) constituting a shunt circuit for magnetic flux created by the primary winding (4).

4 Claims, 5 Drawing Figures

IGNITION COIL FOR INTERNAL COMBUSTION ENGINES

CROSS REFERENCE TO RELATED APPLICATIONS(s)

This U.S. application stems from PCT International Application No. PCT/FR83/00131 filed July 1, 1983.

The present invention relates to an ignition coil, for internal combustion engines, the ignition coil having a closed magnetic circuit constituted by metal sheets which are stamped and stacked one on the other; a permanent magnet disposed in an arm of thickness E of said circuit; primary and secondary windings housed in an insulating housing surrounding another arm of thickness E'.

This ignition coil includes a magnetic flux shunt circuit such that the flux inversion created in the arm of thickness E', by the current flowing in the primary winding, does not demagnetise the permanent magnet.

This magnetic flux shunt circuit is constituted by two metal plates of mild steel, which sheets have tabs each provided with a hole, or an opening, which receives a screw for fixing the ignition coil on the motor vehicle.

Such ignition coils, known particularly from French Patent Application Nos: FR-A-2.476.218 and 2.486.160, have the disadvantage that in order to render the arms of thickness E and E' rigid by means of rivets, it is necessary that the ends of the arm E' should be overlapped which requires the provision of one stamping tool for the metal sheets constituting the arm of thickness E' and three stamping tools for the group of sheets constituting the arm E.

Another disadvantage is that the magnetic circuit can only be made rigid after the insulating housing containing the primary and secondary windings has been located on the arm of thickness E' and, in a second stage a certain number of metal sheets have been stacked on the arm of thickness E, so as to constitute a stack of a thickness corresponding to the thickness E'.

After this, in a third stage, the circuit must be completed by the metal sheets of the arm of thickness E which ensure the overlapping of the ends of the arm of thickness E'.

These successive operations represent a portion of the cost price of these coils which is not negligible.

The object of the present invention is to remedy these disadvantages and to this end it relates to a coil having a closed magnetic circuit constituted by stamped metal sheets which are stacked one on the other, the ignition coil having a permanent magnet disposed in one of the arms of the closed magnetic circuit; primary and secondary windings housed in an insulating housing surrounding another arm, and a magnetic flux shunt circuit, characterized in that the closed magnetic circuit includes a first part of thickness E' and having a U-shape, of which one of the portions is stamped with a chamfered edge, and a second part of thickness E greater than the thickness E', which second part, being L-shaped, has a portion which is stamped with a chamfered edge in such a way that after the insulating housing containing the primary and secondary windings has been located on the arm of thickness E', and the first and second parts have been inserted between the chamfered portions, the said parts are made rigid by means of the metal plates constituting the magnetic flux shunt circuit.

A first advantage produced by this invention is that the stamping of the metal sheets of the magnetic circuit requires only one tool per part, which reduces the outlay for stamping tools.

A second advantage is the reduction in the assembly time, by reason of the fact that the metal sheets, which in the prior art ensured that the magnetic circuit was rigid by overlapping the ends of the arm E', are removed, the magnetic circuit being made rigid by an extension of the metal plates constituting the magnetic flux shunt circuit.

The description which follows, with reference to the accompanying drawings, will facilitate a better understanding of how the invention may be carried out.

Figure 1:
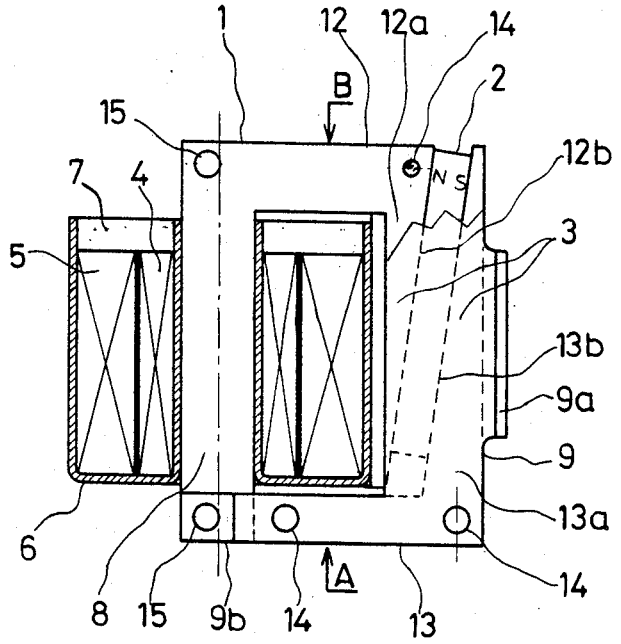
FIG. 1 is a longitudinal view of an ignition coil in accordance with the invention.

In accordance with a preferred embodiment, the ignition coil of the invention, FIG. 1, has a closed magnetic circuit 1 constituted by metal sheets which are stamped and stacked one on the other. in a manner known from French Patent Application No. FR-A-2,476.218, a permanent magnet 2, magnetised in the direction of its thickness, is disposed in an arm 3 of the closed magnetic circuit 1.

Figure 2:
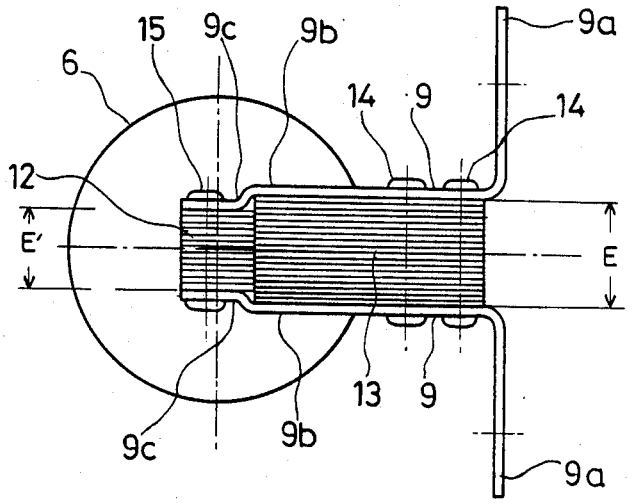
FIG. 2 is a side view along the arrow A, of the ignition coil of FIG. 1.
Figure 3:
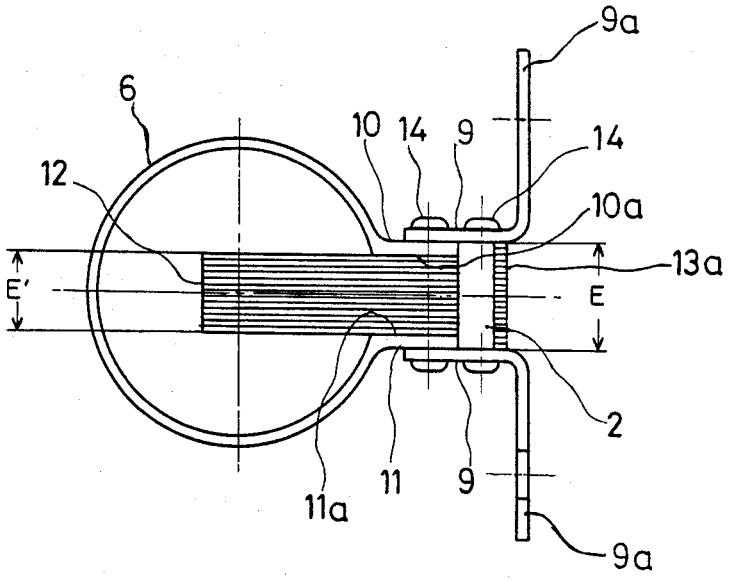
FIG. 3 is a side view, along the arrow B, of the ignition coil of FIG. 1.

A primary winding 4 and a secondary winding 5 housed in an insulating housing 6 are encapsulated in a resin 7, the insulating housing 6 surrounding an arm 8 of thickness E', FIGS. 1, 2 and 3.

In a manner known from French Patent Application No. FR-A-2.486.160 the magnetic flux shunt circuit is constituted by two plates 9 of mild steel, disposed, by means of insulating plates 10 and 11, to either side of the planes defining the thickness E of the arm 3.

The metal plates 9, which are curved symmetrically, have tabs 9*a*, each provided with a hole or an opening, not shown, in such a way as to ensure the fixing of the ignition coil on the motor vehicle.

Figure 4:
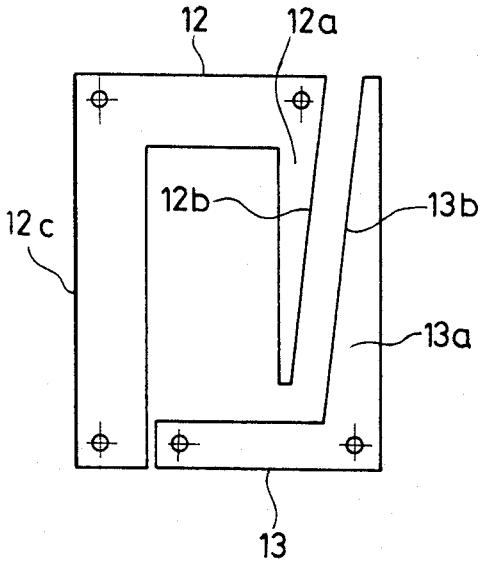
FIG. 4 is a view from above of the stamped metal sheets constituting by stacking one on the other, the first and second parts of the closed magnetic circuit of the ignition coil of FIG. 1.
Figure 5:
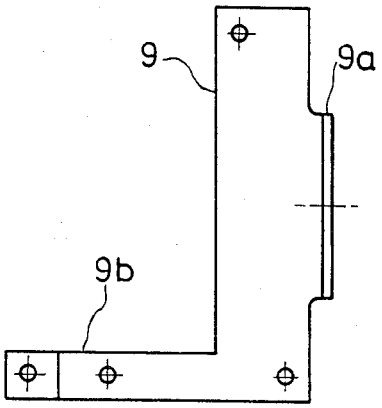
FIG. 5 is a view from above of one of the two metal sheets constituting the magnetic flux shunt circuit, with which the ignition coil of FIG. 1 is provided.

In accordance with the invention, the closed magnetic circuit 1, includes a first part 12, FIGS. 1 and 4.

The first part 12 is constituted by metal sheets, stamped in a U-shape, including a portion 12*a* stamped with a chamfered edge 12*b*.

After the metal sheets have been stacked on one another, the portion 12*a* forms a half-section of the arm 3, and a portion 12*c* forms the arm 8 of the closed magnetic circuit 1.

A second part 13 of the closed magnetic circuit 1, FIGS. 1 and 4, is constituted by metal sheets stamped in an L-shape, which metal sheets include a portion 13*a* stamped with a chamfered edge 13*b*, in such a way as to form the other half-section of the arm 3.

The first and second parts 12 and 13 are made rigid, by known means, such as rivets 14 and 15, and by extensions 9*b* of the plates 9 constituting the magnetic flux shunt circuit.

In accordance with the present invention, the portion 13*a* of the second part 13 of the closed magnetic circuit 1 and the permanent magnet, FIG. 3, are in contact with the metal plates 9 of the magnetic flux shunt circuit in such a way that the air gap reluctance of said circuit should be equivalent to the air gap reluctance of the circuit described in French Patent Application No. FR-A-2.486.160.

As a result, the plates 10 and 11 of the present invention have a thickness equal to 2d with respect to the thickness d of the insulating plates of French Patent Application No. FR-A-2.486.160.

According to the present invention the insulating plates 10 and 11 are made by moulding with the insulating housing 6, and their internal faces 10*a* and 11*a* constitute a housing for the portion 12*a* of the first part 12 of the closed magnetic circuit 1, FIG. 3.

So as to compensate for the difference in the thicknesses E and E′ the extension 9*b* of the metal plates 9 has a camber 9*c*, FIG. 2.

I claim:

1. An ignition coil for internal combustion engines, the coil having a closed magnetic circuit constituted by metal sheets which are stamped and stacked one on the other; a permanent magnet disposed in an arm of the circuit; primary and secondary windings in an insulating housing surrounding another arm of the circuit, the ignition coil including a magnetic flux shunt circuit, the circuit being constituted by plates of mild steel, the coil being characterized in that the closed magnetic circuit includes a first part, of thickness E′ and U-shaped, of which one of the portions is stamped with a chamfered edge and a second part of thickness E greater than the thickness E′, which second part is L-shaped and has a portion which is stamped with a chamfered edge, the permanent magnet being inserted between the chamfers of the first and second parts, and the first and second parts being rigidified by extensions of the metal plates, and by rivets extending through said extensions and through the stacked sheets.

2. An ignition coil according to claim 1, characterized in that the portion of the second part of the closed magnetic circuit and the permanent magnet are in contact with the metal plates of the magnetic flux shunt circuit.

3. An ignition coil according to claim 1, characterized in that the portion of the first part of the closed magnetic circuit is disposed inside a housing constituted by internal faces of plates which are integral with the insulating housing.

4. An ignition coil according to claim 1 characterized in that the extensions of the plates include bends at their ends.

* * * * *